United States Patent [19]

Day

[11] 4,156,483

[45] May 29, 1979

[54] CUPS CAPABLE OF NESTING

[75] Inventor: Robert H. Day, Bracknell, England

[73] Assignee: Illinois Tool Works Inc., Chicago, Ill.

[21] Appl. No.: 901,872

[22] Filed: May 1, 1978

[30] Foreign Application Priority Data

May 3, 1977 [GB] United Kingdom ..... 18404/77

[51] Int. Cl.[2] ..... B65D 21/02

[52] U.S. Cl. ..... 206/217; 206/520

[58] Field of Search ..... 206/519, 520, 217, 219, 206/221; 229/15 B

[56] References Cited

U.S. PATENT DOCUMENTS

| | | | |
|---|---|---|---|
| 3,512,677 | 5/1970 | Kovac | 206/520 |
| 3,519,165 | 7/1970 | Hawley | 229/1.5 B |
| 3,696,987 | 10/1972 | Schuff et al. | 229/1.5 B |
| 3,721,367 | 3/1973 | Fletcher | 206/519 |
| 3,739,939 | 6/1973 | Koenig | 206/520 |
| 3,820,684 | 6/1974 | Harrison | 206/520 |
| 3,927,766 | 12/1975 | Day | 206/217 |

*Primary Examiner*—Herbert F. Ross
*Attorney, Agent, or Firm*—Thomas W. Buckman; Edward L. Benno; Robert W. Beart

[57] ABSTRACT

A cup comprising a bottom and sidewall, the cup being shaped so that it can be assembled into a stack between other identical cups, in upright attitude, into a condition in which:

(a) the upper of two adjacent cups is supported by the cup below, without jamming, (b) the two adjacent cups define between them a space, (c) the two adjacent cups are restrained from axial displacement away from each other unless predetermined axial separating forces are applied to the two cups, (d) the space is cut off from atmosphere by a seal, or near-seal, provided by cooperation between a circumferential surface on one of the two adjacent cups and a circumferential line or surface on the other of the two cups, (e) the support is provided in conjunction with the seal or near-seal, or by separate cooperating portions of the two cups, (f) and the restraint is provided by the seal or near-seal, or by separate cooperating portions of the two cups, the cup being distinguished by the features that:

(g) the cup is of integral construction, of a cellular plastics material, of substantial wall thickness, (h) and the dimensions of the cup prior to assembly with identical cups are such that the establishment of the support and restraint defined in (e) and (f) involves localized indentation of the exterior, or the interior, or both, of the cup, with consequent localized compression of the cellular plastics material.

6 Claims, 10 Drawing Figures

CUPS CAPABLE OF NESTING

In one known procedure for vending drinks from a machine, a considerable number of cups are supplied to the machine nested together into a stack, with an appropriate quantity of soluble drink ingredient located in each of the spaces which exist between the bottom of one cup and the bottom of the next cup above. In use, cups are removed one by one from the bottom of the stack, and each cup is filled with water, usually nearly boiling, which thereupon dissolves the ingredient. Thus a drink is produced in each cup, ready for consumption.

Such cups can also be used in a dispenser from which cups can be removed one at a time by hand.

The present invention relates to cups which are suitable for these uses. Such cups comprise a bottom and a sidewall, the cup being shaped so that it can be assembled into a stack between other identical cups, in upright attitude, into a condition in which:

(a) the upper of the two adjacent cups is supported by the cup below, without jamming, (b) the two adjacent cups define between them a space, (c) the two adjacent cups are restrained from axial displacement away from each other unless predetermined axial separating forces are applied to the two cups, (d) the space is cut off from atmosphere by a seal, or near-seal, provided by cooperation between a circumferential surface on one of the two adjacent cups and a circumferential line or surface on the other of the two cups, (e) the support is provided in conjunction with the seal or near-seal, or by separate cooperating portions of the two cups, (f) and the restraint is provided by the seal or near-seal, or by separate cooperating portions of the two cups.

According to the present invention:

(g) the cup is of integral construction, of a cellular plastics material, of substantial wall thickness, (h) and the dimensions of the cup prior to assembly with identical cups are such that the establishment of the support and restraint defined in (e) and (f) involves localised indentation of the exterior, or the interior, or both, of the cup, with consequent localised compression of the cellular plastics material.

This represents an entirely fresh approach to the provision of cups for the uses referred to above. Hitherto, such cups have all been thin-walled, of dense homogeneous plastics material, e.g., high impact polystyrene, with an average wall thickness of 0.2 mm. A suitable material for the present invention, is expanded polystyrene, with a wall thickness typically in the range 1.0 to 3.0 mm.

By the use of cellular plastics material, the total weight of the cup can be made less than hitherto, and this represents an economy in material and in cost.

The arrangement defined in (h) above does not depend upon absolutely exact dimensions, nor on exact circularity of cups. Mass-production moulding inevitably gives rise to tolerances in dimensions and in circularity. The localised compression can vary to accommodate such tolerances.

Preferably the dimensions of the cup prior to assembly with identical cups, and the elastic behaviour of the cellular plastics material, are such that, when the support and restraint have been established, the sealing surfaces (or surface and line) are clamped together under substantial force.

If the substantial force is distributed around the entire circumference of the sealing surfaces (or surface and line), then a continuous seal is attained.

The accompanying drawings are diagrams illustrating some examples of cups embodying the present invention. In these drawings.

Figure 1:
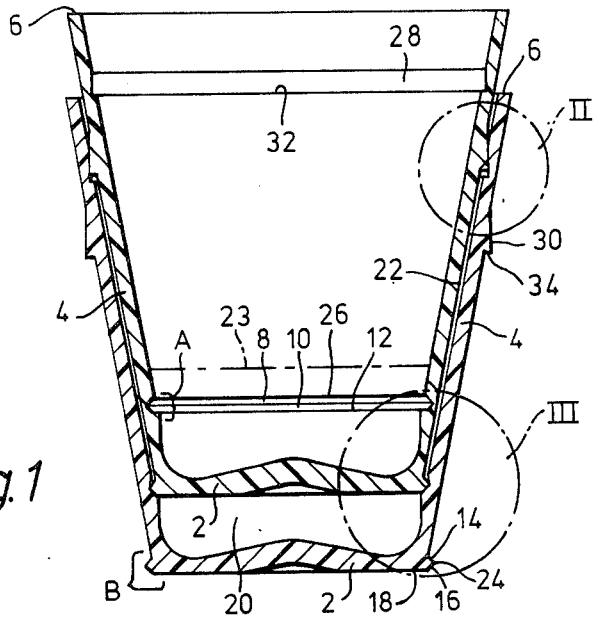
FIG. 1 is a vertical section of two cups stacked together.

The cups shown in FIG. 1 have a flush-filled capacity of 220 cc. Each has a bottom wall 2 and a sidewall 4, the side wall having a shape which, basically, is divergent upwards and outwards from the bottom wall to an upper edge 6. The wall thickness range of 1.0 to 3.0 mm, mentioned above, refers to the majority of the side wall 4. The bottom wall 2 is somewhat thicker than the side wall.

When a number of identical cups as shown in FIG. 1 are assembled together in a stack in an upright attitude, interengagement of the cups takes place by cooperation between a wall portion A on one cup and a wall portion B on another cup. That is to say the internal surfaces of the portion A cooperate with the external surfaces of the portion B of the next cup above in the stack, while external surfaces of the portion B cooperate with internal surfaces of the portion A of the next cup beneath in the stack. The nested condition of two adjacent cups in the stack is as shown in FIG. 1.

The wall portion A has internal surfaces 8, 10 and 12. The wall portion B has external surfaces 14, 16 and 18.

The surfaces 8 and 10 together define a continuous circumferential V-sectioned groove internally in the wall portion A, while the surfaces 14 and 16 together define a continuous circumferential rib on the exterior of the wall portion B. This rib is immediately adjacent to the bottom wall 2.

The surface 12 is a flat annular upward-facing surface on an internal step in the side wall 4. In effect the side wall 4 is thickened from the surface 12 down to the junction of the side wall 4 and bottom wall 2. The groove 8, 10 is immediately adjacent to the surface 12. The surface 18 is part of a flat external surface of the bottom wall.

In the assembled condition, the surfaces 12 and 18 are in interengagement over a continuous annular zone, and thus simultaneously provide a seal and the entire support. The seal cuts off from the external atmosphere a space 20 defined between the bottom walls 2 of the two adjacent cups. The support prevents the cups moving closer together in a vertical direction, and thus ensures that there is a clearance at 22 between the side walls 4 of the two adjacent cups, and consequently no risk of jamming of the cups together.

At the same time, the surfaces 8 and 14 are in interengagement, and thus provide restraint against axial displacement of the cups away from each other, unless predetermined axial separating forces are applied to the two cups. These surfaces 8, 14 are distinct from the surfaces 12, 18.

The surfaces 10 and 16 are purely linking surfaces, and perform no mechanical interengagement function.

The proportions of the wall portions A and B are such that, when the surfaces 12 and 18 are just in contact, there is substantial interference between the surfaces 8 and 14. What actually happens is that, during assembly of the two cups, the crest 24 of the rib 14, 16 of the upper cup first makes contact with the interior of the lower cup at approximately a line indicated at 23. Further downward movement of the upper cup relatively to the lower cup results in local deformation of the rib 14, 16, accompanied by local deformation of the interior of the side wall 4 of the lower cup at successive zones moving downwards from the line 22 to the groove 8, 10. In effect, the cellular structure of the plastics material is locally crushed, but remains capable of resilient recovery, total or partial. After the crest 24 of the rib 14, 16 has passed the upper boundary 26 of the surface 8, the deformed cellular plastics material of each cup partially recovers its original shape, but not entirely so. In the final assembled condition, the surface 14 of the lower cup is still somewhat indented locally, with consequent localised compression of the adjacent cellular plastics material, and the surface 8 of the lower cup is in a condition of localised indentation, with consequent localised compression of the adjacent cellular plastics material of the side wall of the lower cup. This localised compression of the side wall is not accompanied by any significant change in the external shape of the side wall.

Because of these conditions of localised compression, there are stresses in the material adjacent to the surfaces 8 and 14, having the effect of urging the upper cup downwards relatively to the lower cup, and thus clamping the sealing surfaces 12 and 18 in firm interengagement. In consequence, there is localised compression of the cellular plastics material adjacent to the surfaces 12 and 18, but since the area of interengagement of the surfaces 12, 18 is greater than the area of interengagement of the surfaces 8, 14, the extent of compression adjacent to the surfaces 12, 18 is less.

In order to separate the cups, it is necessary to apply opposed forces to the two cups, upwards on the upper cup and downwards on the lower cup, of a magnitude sufficient both to overcome these clamping forces, and thereupon to cause the rib 14, 16 to ride upwards relatively to the surface 8, past the boundary 26, with consequent increased deformation of the rib 14, 16 of the upper cup and of the side wall 4 of the lower cup, until the upper cup is out of contact with the lower cup.

Figure 2:
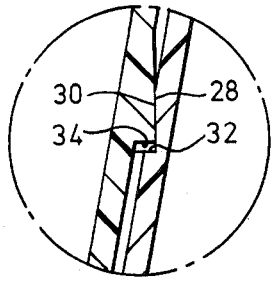
FIG. 2 is an enlarged detail within the circle II in FIG. 1.

The sealing action between the surfaces 12 and 18 is liable to be disturbed if the upper cup experiences substantial forces tending to tilt it relatively to the lower cup (by tilting is meant rotation of the vertical axis of a cup clockwise or anti-clockwise as seen in FIG. 1, through a small angle). In order to resist such tilting, a portion of the upper half of the side wall has an internal vertical cylindrical surface 28, and an external vertical cylindrical surface 30. These two surfaces 28, 30 are of substantially equal diameter, and each of these surfaces is bounded at its lower edge by a respective step 32, 34. FIG. 2 shows the manner in which the surfaces 28 and 30 of adjacent cups come into sliding engagement, while the steps 32 and 34 remain slightly spaced apart, and thus have no adverse effect on the interaction of the wall portions A and B. Thus the surfaces 28 and 30 serve to maintain the axes of the two cups in alignment with one another, but perform no other function (except that they may constitute an auxiliary seal).

Figure 4:
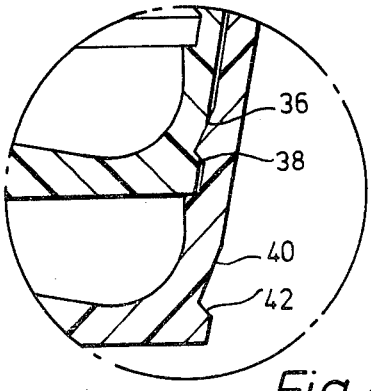
FIG. 4 is an alternative to FIG. 3.

FIG. 4 shows an alternative construction, in which the wall portion A has an internal rib 36, 38, and the wall portion B has an external groove 40, 42. In use, the surfaces 38 and 42 cooperate to perform the same function as the surfaces 8 and 14. The surfaces 36 and 40 are purely linking surfaces.

Figure 3:
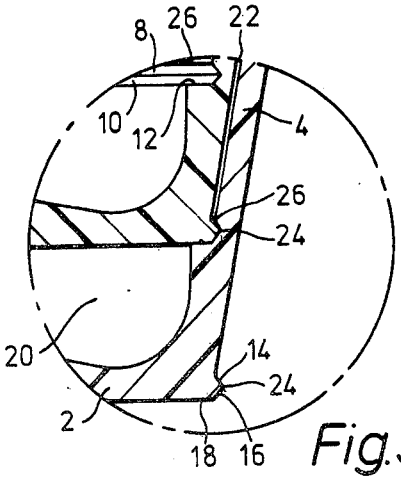
FIG. 3 is an enlargement of the detail within the circle III in FIG. 1.
Figure 5:
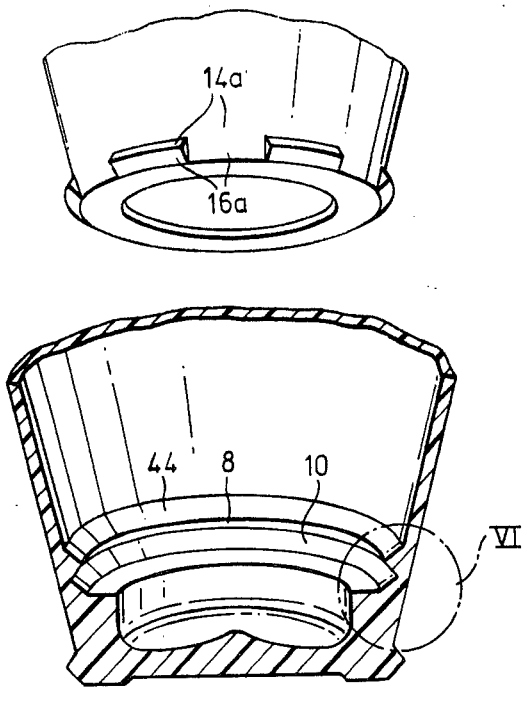
FIG. 5 is a fragmentary perspective view of the cooperating parts of two cups, shown separated, with the lower cup in vertical section.

FIG. 5 shows a construction resembling that shown in FIGS. 1, 2 and 3, but differing in that the rib **14*a*, 16*a* is circumferentially interrupted. With this construction, localised indentation is confined to the rib portions 14*a*, 16*a***, and to those parts of the other cup engaged by them, and the majority of the compression of material takes place in the rib portions.

Furthermore, in FIG. 5 (and in the detail of FIG. 6) the side wall is increased in thickness in the neighbourhood of the surface 8 so that in effect the surface 8 is simultaneously the upper surface of an internal groove, and the lower surface of an internal rib, the rib having an upper surface 44. In the assembled condition, the surface 44 performs no function, but it serves as a lead-in for the rib portions **14*a*, 16*a*** during assembly.

Figure 7:
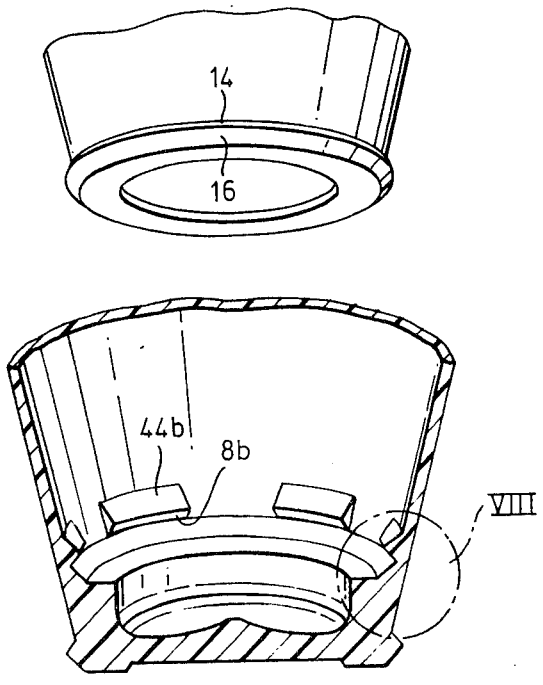
FIG. 7 is a view similar to FIG. 5, of another construction.
Figure 6:
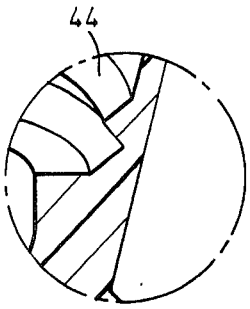
FIG. 6 is an enlargement of detail within the circle VI in FIG. 5.
Figure 8:
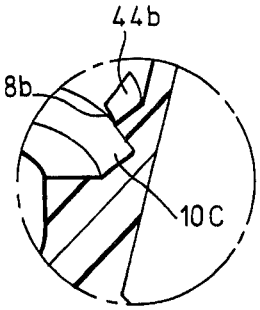
FIG. 8 is an enlargement of the detail within the circle VIII in FIG. 7.

FIGS. 7 and 8 show another construction which differs from FIGS. 5 and 6 in that there is a continuous external rib 14, 16, but the internal rib **44*b*, 8*b* is interrupted. Here the localised indentation in the assembled condition is primarily in the surfaces 8*b***.

Figure 9:
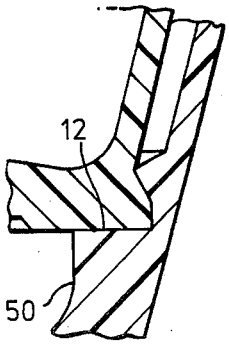
FIG. 9 is a fragmentary section showing another alternative.

FIG. 8 also shows a further variant in which the surface 10 is replaced by a cylindrical surface **10*c*. This enables one to have a larger radial extent of sealing zone between the surfaces 12 and 18, as illustrated in FIG. 9. For this purpose, the surface 16 of FIGS. 1 to 3** is replaced by a cylindrical surface extending downwards from the crest of the rib.

Figure 10:
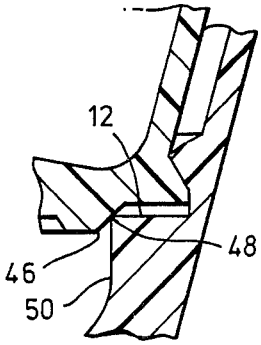
FIG. 10 is a fragmentary section showing a further alternative

FIG. 10 shows an alternative arrangement in which the seal is between an oblique surface 46 on the bottom wall of the upper cup, and a shoulder 48 constituted by the junction between the horizontal surface 12 and a downwardly extending surface 50 on the side wall of the lower cup.

Cups as shown can be made by normal well-known techniques for making articles of cellular plastics material, in a closed mould. The interruption of a rib, as in FIGS. 5 and 7, may facilitate removal of a warm newly-made cup from a mould.

Interruptions of ribs may also have the advantage that they facilitate escape of air when cups are being assembled into a stack, and entry of air to the space 20 when a cup is being separated from a stack. Such interruption may be total, i.e., for the full radial height of the rib, or may be partial, i.e., a local reduction of the radial height of the rib. The latter is desirable if the rib carries one of the sealing surfaces (in the examples shown in the drawings, this is not the case).

I claim:

1. A cup of cellular plastic material comprising a bottom wall and conical side wall extending upwardly and outwardly relative to the bottom wall, the cup being configured so as to be assembled into a stack of identical cups with the upper of two adjacent cups supported by the cup below without jamming and creating a sealed space between bottom walls of adjacent cups, a first external support and sealing surface means formed on each cup adjoining the bottom wall thereof said first surface being in the form of a continuous annular flat peripheral surface, a second external sealing and locking surface means having its maximum diameter spaced upwardly and outwardly a slight distance from the maximum of said first surface forming a crest and extending upwardly relative to the first surface and inwardly from said crest toward the inner sidewall surface of the cup, a third, internal support and sealing surface means formed in the inner sidewall of the cup, said third surface being spaced upwardly relative to the second surface and first surface and being in the form of an annular, continuous flat ledge with a minimum diameter which is less than the maximum diameter of the first furface, wherein the first surface of an upper of two adjacent identical cups cooperate with the third surface of a lower of two adjacent identical cups to form a positive support and a space between the outer lower wall surface of the upper cup and the inner lower wall surface of the lower cup, a fourth internal sealing and locking surface means having its maximum diameter spaced upwardly a slight distance from the third surface, said slight distance being not greater than the distance between the first and second surfaces, the fourth surface extending inwardly and downwardly into the wall to its maximum diameter, the minimum diameter of the fourth surface means being less than the maximum diameter of the second surface means wherein the second surface means of an upper of two adjacent identical cups cooperate with the fourth surface of a lower of two adjacent identical cups to compressingly seal the respective first and third surfaces together as well as compressingly seal said second and fourth surfaces together while permitting selective camming disengagement of the lower cup downward relative to the upper cup.

2. The cup of claim 1 which is further provided with fifth and sixth surface means both of which are spaced upwardly on the sidewalls above the fourth surface on each cup, the fifth surface being external wall surface in the form of a camming and stabilizing protuberance, the sixth surface being an internal wall surface recess spaced above the fifth surface a distance consistent with the spacing between the first and third surfaces, said sixth surface being a camming surface cooperating with a fifth surface on an upper adjacent cup, the maximum diameter of the fifth surface being not less than the minimum diameter of the sixth surface so that the two surfaces on adjacent cups cooperate to resist tilting of the cups relative to a central axis of a stack.

3. A cup according to claim 2, in which a portion of the fifth surface is an external cylindrical surface and a portion of the sixth surface an internal cylindrical surface, these two surfaces being of substantially equal diameter and placed to cooperate with respective like surfaces of adjacent cups.

4. A cup according to claim 1, in which the dimensions of the cup prior to assembly with identical cups, and the elastic behaviour of the cellular plastics material, are such that, when the support and restraint have been established, the sealing surfaces (or surface and line) are clamped together under substantial force.

5. A cup according to claim 1, in which the substantial force is distributed around the entire circumference of the sealing surfaces (or surface and line).

6. A cup according to claim 1, in which the support relative to adjacent cups is provided solely in conjunction with the seals with adjacent cups.

* * * * *